United States Patent [19]

Quinn et al.

[11] 4,002,140

[45] Jan. 11, 1977

[54] RADIO STATION IDENTIFIER

[76] Inventors: Billy Roy Quinn, 12911 Galoway, Apt. 201, Garden Grove, Calif. 92641; Jimmy Don Quinn, 425 N. Magnolia, Apt. E, Anaheim, Calif. 92801

[22] Filed: Oct. 14, 1975

[21] Appl. No.: 621,867

[52] U.S. Cl. ..... 116/135

[51] Int. Cl.[2] ..... G09F 9/40

[58] Field of Search ..... 116/124.1 A, 135, 130, 116/114 R; 235/89 R, 85 R; 40/64 R

[56] References Cited

UNITED STATES PATENTS

| | | | |
|---|---|---|---|
| 2,290,822 | 7/1942 | Basso | 116/124.1 R |
| 2,903,808 | 9/1959 | Anderson | 116/135 |
| 3,650,467 | 3/1972 | Sellie | 235/89 R |
| 3,790,074 | 2/1974 | Zemanek | 235/89 R |
| 3,853,265 | 12/1974 | Kunert | 235/89 R |

*Primary Examiner*—Donald O. Woodiel
*Assistant Examiner*—Denis E. Corr
*Attorney, Agent, or Firm*—William C. Babcock

[57] ABSTRACT

A look-up device formed in the manner of a rectangular envelope open at the ends for sliding receipt of a rectangular slide on the interior thereof. Formed in the envelope is a rectangular window including radio frequency inscriptions along the longitudinal edges thereof. The slide is translated within the envelope to align one edge thereof against a selected frequency, and the corresponding call letters printed on the face of the slide are then aligned with one edge of the envelope.

4 Claims, 5 Drawing Figures

RADIO STATION IDENTIFIER

BACKGROUND OF THE INVENTION

1. Field of the Invention

The present invention relates to a look-up device, and more particularly to a device conformed in the manner of a slide rule for correlating the call letters of a station with the frequency thereof.

2. Description of the Prior Art

In ham radio operations and in selecting a particular radio station for listening, very often the user either knows the frequency at which the station is to be selected, or the call letters, but very rarely does he know both. Generally the band width required for transmission varies logarithmically with the particular center frequency. Thus, as a particular wavelength is selected the density of the stations adjacent thereto varies according to the wavelength. Most often the tuning display of a radio will combine several frequency bands and a display of both the frequency and the call letters of a station thus is often impractical. Accordingly, a user who recollects either the frequency or the call letters cannot conveniently cross correlate between two pieces of information from the visual display on the tuning dial.

SUMMARY OF THE INVENTION

Therefore it is the general purpose and object of the present invention to provide a radio station identifier formed in the manner of a slide rule where one index of the slide rule can be aligned with a particular frequency while the other index provides the visual indication of the call letters.

Further objects of the invention are to provide a radio station identifier which is convenient in use, easy to produce and requires few parts.

These and other objects are accomplished according to the present invention by forming a plastic envelope having a window formed longitudinally in one face thereof, and having inscribed along said window various radio frequencies for identification. Insertable into the envelope for sliding translation longitudinally therein is a rectangular insert or slide having one edge thereof formed as the index mark for alignment relative to any selected frequency. The envelope is similarly provided with a transverse cut-off along one end thereof which forms a second index along one end thereof which forms a second index against which inscripitons on the slide are looked up. Such inscriptions are printed on both sides of the rectangular slide, providing a display of call letters whereby the alignment of the first index will immediately display, at the second index, the appropriate station. Thus, by inscribing along the edges of the window, the various transmission frequencies, such as FM and AM, and selecting the appropriate side of the slide correlation of AM or FM frequencies with corresponding call letters can be made.

In order to facilitate fabrication, the envelope is formed by convolving a tubular plastic section to a rectangular planform conformed for receipt of the slide. The plastic sheet thus forms a rectangular envelope open at both ends having inscribed thereon the necessary inscriptions of frequency on either side of an opening at the window. The slide itself can be either an opaque or a translucent sheet of plastic again having inscriptions thereon as required to provide the designation of the selected call letters.

DESCRIPTION OF THE SPECIFIC EMBODIMENT

Figure 1:
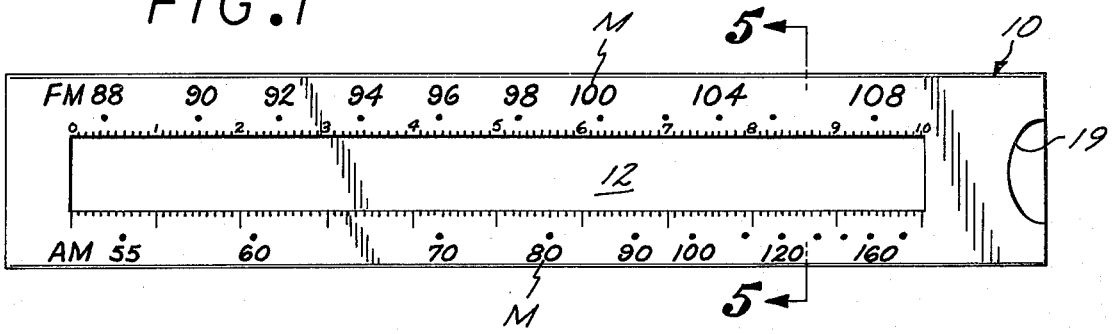
FIG. 1 is a front plan view of a radio station identifier constructed according to the present invention.
Figure 3:
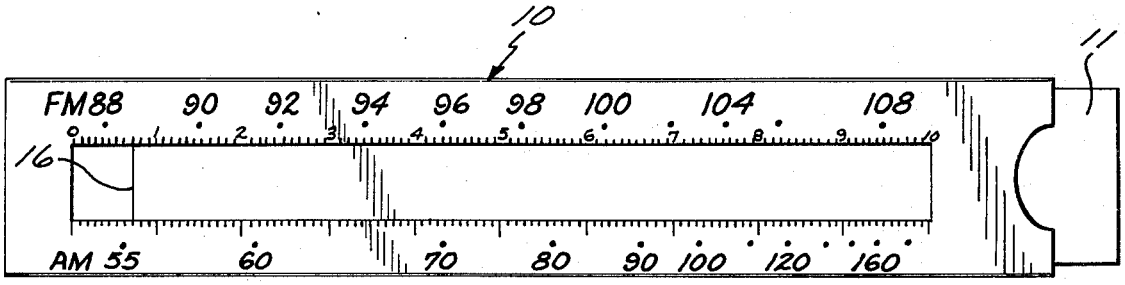
FIG. 3 is a front plan view, once again, illustrating the inventive device when used according to the teachings herein.

As shown in FIGS. 1 and 3, the inventive radio station identifier comprises a rectangular, plastic sheet envelope 10 open at the ends thereof for sliding receipt of a rectangular slide 11. Envelope 10 is formed by compressing a section of plastic tubing to a rectangular planform and is therefore closed along the longitudinal edges thereof. Formed on one exterior surface 13 of envelope 10 are a plurality of frequency markings, designated as markings M, which are inscribed adjacent the longitudinal edges of a window 12. Window 12, similar to envelope 10, is rectangular in planform and may be provided with, for example, the frequency markings along the upper longitudinal edge thereof and the AM frequency markings along the lower longitudinal edge.

Figure 2:
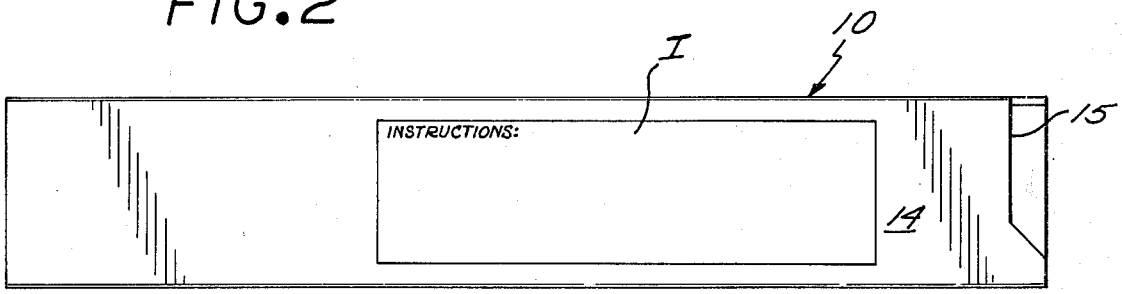
FIG. 2 is a rear plan view of the inventive device illustrated in FIG. 1.
Figure 4:
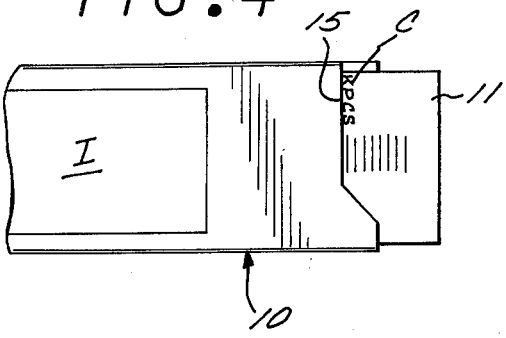
FIG. 4 is a sectional rear view of the device shown in FIG. 3.

As shown in FIGS. 2 and 4, envelope 10 includes a rear surface 14, disposed along surface 13, which may be inscribed with instructions I advising the user of the proper use of the instrument. One end of surface 14 is cut off along a transverse index cut 15 to a dimension smaller than the longitudinal dimension of the front surface 13. By way of this arrangement, one edge of the slide 11 provides a frequency index and is therefore designated herein as the index edge 16, while the index cut 15 on the rear surface on the envelope 10 provides the other index. A plurality of call letters C printed on both sides of slide 11 can thus be aligned relative to the index 15 by aligning the edge of the slide relative to a selected frequency.

Figure 5:
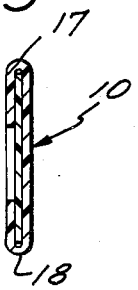
FIG. 5 is a sectional view, taken along line 5—5 of FIG. 1.

As shown in FIG. 5, the sectional shape of envelope 10, achieved by compressing a tubular plastic section, form the two adjacent surfaces 13 and 14 which are separated by an interior gap 21 having received therein the slide 11. Formed in the tubular section prior to the compression thereof is the opening or window 12 following which the inscriptions M are deposited therealong. By way of this technique, the front and rear surfaces 13 and 14 are joined and thus fixed by two longitudinal joining beads 17 and 18 which are integral with the structure thereof. It is contemplated that this manner of manufacture be achieved by concurrently heating the plastic tube to its point of plastic flow.

Once the tube is thus reformed into the envelope 10, the appropriate index cut-out 15 is then made.

In addition, a finger cut-out 19 is formed in the front surface 13, along one lateral edge thereof, to allow for manual manipulation of the inserted slide 11. By way of this cut-out, slide 11 may be manipulated within envelope 10 aligned with a selected fact thereof being presented for indexing against index 15.

Some of the many advantages of the present invention should now be readily apparent. The invention provides by way of a simple production technique, a device which is convenient in use, simple to maintain and which requires few parts.

Obviously many modifications and variations are possible in the light of the above teachings. It is therefore intended that the scope of the invention be determined solely by the claims appended herein.

We claim:

1. A radio station identifier for correlating the call letters of a sending station with the frequency thereof, comprising:

a rectangular plastic envelope formed by compressing with heat a section of plastic tubing, said envelope including openings at the ends thereof, a rectangular window in one surface thereof, and a transverse cut-out formed at one of said ends in the other surface thereof for providing an index line for visual alignment;

a rectangular slide receivable within the interior of said envelope and conformed for translation therein having a longitudinal dimension substantially equal to the longitudinal dimension of said envelope;

frequency markings formed on said envelope adjacent the longitudinal edges of said window; and call letter markings formed on said slide in corresponding relationship with at least one end thereof for alignment of a predetermined call letter marking in one end of said slide is aligned relative a corresponding frequency marking at one of said edges of said window.

2. Apparatus according to claim 1 wherein said envelope comprises a rectangular front surface, including said window, a rectangular rear surface conformed to the dimensions of said front surface and means for joining the longitudinal edges of said front and rear surfaces at a predetermined interval of separation.

3. Apparatus according to claim 2 wherein said slide is conformed for receipt within the separation interval between said front and rear surface.

4. Apparatus according to claim 3 wherein said slide is substantially equal in longitudinal dimension to said front and rear surfaces and said front surface includes a semicircular cut-out proximate on end thereof for manual articulation of said slide.

* * * * *